United States Patent [19]

Davis

[11] 4,016,823

[45] Apr. 12, 1977

[54] RETRACTABLE SAILBOAT MAST

[76] Inventor: Robert S. Davis, 405 W. 3rd St., Homer, Ill. 61849

[22] Filed: May 21, 1976

[21] Appl. No.: 688,597

[52] U.S. Cl. ..... 114/90; 403/107; 403/109

[51] Int. Cl.[2] ..... B63B 15/00

[58] Field of Search ..... 114/90, 91, 102, 108, 114/112, 39; 52/111, 118, 123; 116/173; 248/408; 403/107, 109

[56] References Cited

UNITED STATES PATENTS

| | | | |
|---|---|---|---|
| 8,164 | 6/1851 | Brown | 114/90 |
| 2,353,662 | 7/1944 | Goldman | 114/90 X |
| 2,719,688 | 10/1955 | Seifert | 403/109 X |
| 2,777,692 | 1/1957 | Marzucco | 116/173 X |
| 3,092,064 | 6/1963 | Benedict | 114/112 |
| 3,507,240 | 4/1970 | Butler | 114/90 X |

*Primary Examiner*—Trygve M. Blix
*Assistant Examiner*—Sherman D. Basinger
*Attorney, Agent, or Firm*—Robert D. Farkas

[57] ABSTRACT

This disclosure pertains to a telescoping mast hingeably and removably affixed at the base portion thereof to the deck of a sailboat. A series of inwardly spring biased spheres engage recesses in adjacent telescoping elements of the mast thereby releasably maintaining the mast in an extended position. Each telescoping section of the mast is provided with a longitudinal slot, used to engage a plurality of outwardly radially extending mainsail securing tabs. Circular or elliptical mast cross-sections may be employed, utilizing a flexible line running over the mast top to raise and lower the mainsail.

9 Claims, 6 Drawing Figures

RETRACTABLE SAILBOAT MAST

BACKGROUND OF THE INVENTION

1. The Field of the Invention

This invention relates to mainmasts of sailboat vessels and more particularly to that class utilizing telescoping mast elements. 2. Description of the Prior Art The prior art abounds with telescoping masts. U.S. Pat. No. 3,263,382 issued on Aug. 2, 1966 to M. C. Tourtellotte teaches a telescoping vertically directed cantilevered flag pole having the telescoping elements thereof fitted with threaded set screws adapted for engagement within openings in adjacent telescoping elements so as to maintain the pole in an erected or elongated state.

U.S. Pat. No. 859,233 issued on July 9, 1907 to G. M. Lane discloses a plurality of tubular telescoping elements utilizing a pair of outwardly directed arms and a spring biasing the arms so as to engage holes in opposed positions in the wall of an adjacent layer telescoping element.

The aforementioned patents suffer the common deficiency of requiring the user to operate the locking mechanisms thereof into an unlocking position in order to collapse the mast. Thus the user would have to climb the mast so as to effectively be close enough to the locking mechanisms in order to collapse the mast by the loosening or disengagement thereof. Furthermore, the aforementioned patents do not provide for slideably fastening a mainsail along the length of the mast when extended.

SUMMARY OF THE INVENTION

A primary object of the present invention is to provide a mast which may be collapsed into its shortest position without requiring manual manipulation at the sight of those elements utilized to maintain the mast in an extended position.

Another object of the present invention is to provide a collapsible mast which may be hingeably and removably affixed to a deck of a sailboat.

Still another object of the present invention is to provide a collapsible mainmast which adequately and effectively provides lateral and vertical support to a mainsail leading edge at a plurality of points therealong.

Yet another object of the present invention is to provide a collapsible mainmast whose mainsail supporting means is always maintained abaft the mainmast.

Heretofore, collapsible tubular masts, of the telescoping variety, employed diverse clamping or locking mechanisms to maintain the mast in an extended position requiring physical manipulative efforts at various points along the length of the mast to enable it to be collapsed. Furthermore, such extending devices were heavy and cumbersome and were more directed towards a one time use, such as in erecting a flag pole. Sailing vessels require a light flexible mast structure, which in order to be effective, must be adapted to support a mainsail along a line disposed abaft the mainmast. Of further advantage, is a mainmast which may be stored along the deck of the boat, in a collapsed position, and hingeably affixed thereto so as to enable the vessel's crew to "foot" an extended mast in the erecting or lowering process.

These objects, as well as other objects of the present invention, will become more readily apparent after reading the following description of the accompanying drawings.

DESCRIPTION OF THE PREFERRED EMBODIMENT

Figure 1:
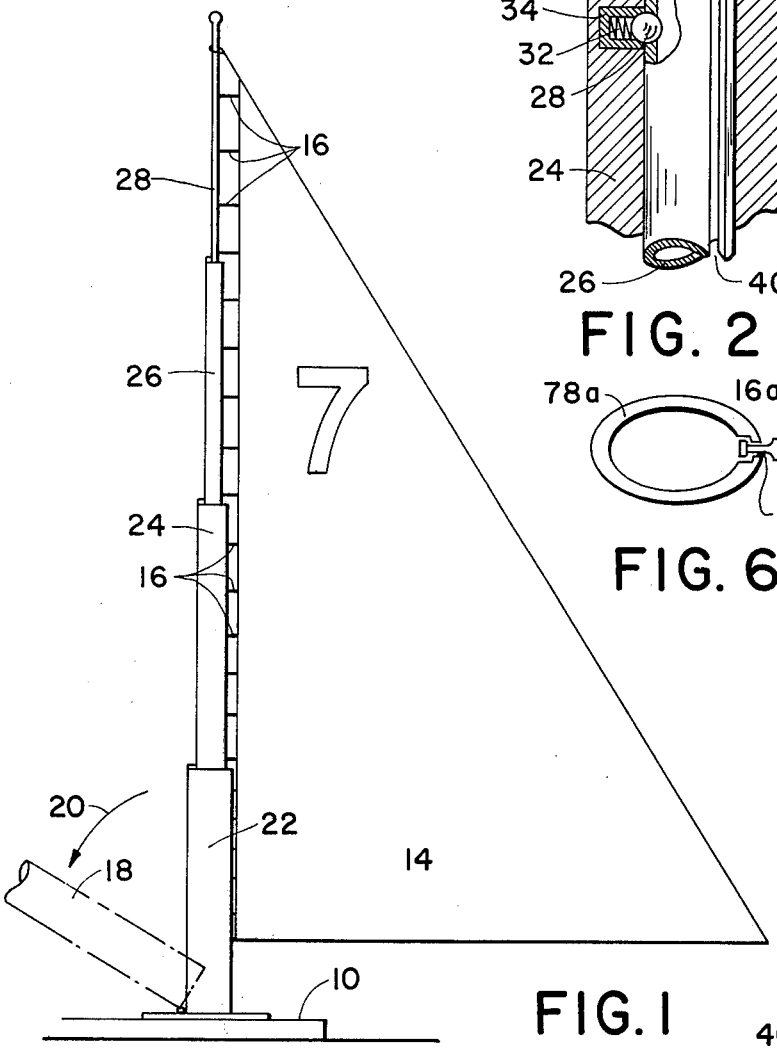
FIG. 1 is a side elevation view of a portion of a sailing vessel having an erected mainmast and mainsail affixed thereto.

The structure and method of fabrication of the present invention is applicable to a plurality of diverse diameter hollow tubes. Each of the tubes is adapted to telescope within an adjacent larger diameter tube and, when extended, to be utilized as a mainmast of a sailing vessel. The uppermost region of each of the tubes, save the smallest, is adapted with a ball or sphere, spring biased inwardly, serving as a disengageable detent, for engagement within an opening disposed adjacent the lowermost end of each tube, save the largest. An anti-rotation protrusion is fastened to the exterior surface of each tube engaging a longitudinal notch in the interior surface of an adjacent tube, so as to maintain the tubular elements of the mast in a fixed rotational alignment regardless of the length of the mast. A slot extends along the length of each mast element and is aligned longitudinally with the slot element of adjacent tubular members, forming thereby, an extended slot running substantially the length of the mast when in an extended position. The innermost walls of each slot are widened adjacent the innermost surface of each tubular element so as to facilitate the engagement of the cap portion of a T-shaped sliding element therewithin, having the leg portion of the T-shaped element extending radially outwardly from the longitudinal axis of the mast. The innermost point of the cap of the T-shaped element is confined within the wall of the tubular element in which it resides, thereby enabling a smaller adjacent tubular element to telescope therewithin without restriction by a portion of the cap of the T-shaped sliding element. The outermost end of the T-shaped sliding elements engage the foremost leading edge of the mainsail so as to provide lateral support thereto against the forces of the wind.

The bottom of the mainmast is secured to one plate of a large barrel-type hinge. The other plate of the hinge is fixedly secured to the deck of the vessel. A removable pin, passing through a block, fixedly secured to the deck, and a pair of holes in the lowermost portions of the lowermost end of the lowermost section, maintains the mainmast in a vertical erected state. Removing the pin allows the mainmast to be pivoted about the longitudinal axis of the hinge pin, thereby permitting the mast to be pivoted in parallel relationship with the deck of the vessel. Upon the removal of the hinge pin, the entire mast and the upper plate of the barrel-hinge affixed thereto may be removed from engagement with the vessel deck.

An alternate means of fastening the mainsail to the mainmast includes an opening, disposed in the vertical direction, in each free end of each T-shaped sliding element, adapted to permit a mainsail supporting line to pass therethrough. Tabs, affixed to the leading edge of the sail, securely grasp the line, which when raised or lowered, causes the said to be raised or struck a height roughly equivalent to the free extended portions of the extended elements of the mainmast. This embodiment may be utilized for tubular elements having circular as well as elliptical cross-sections. The line passes over a pulley affixed to the mast top and then descends downwardly towards the deck. To collapse the mast, in the upright position, the crew simply exerts a downward force on both lowermost ends of the line sufficient to overcome the detenting forces exerted by the spheres and the openings in which they reside.

Now referring to the Figures, and more particularly to the embodiment illustrated in FIG. 1 showing the deck 10 of a sailing vessel supporting mast 12 vertically thereabove. Mainsail 14 is supported by mast 12 utilizing sliding elements 16 therefor. Dotted lines 18 illustrates the mast 12 as it is being pivoted in the direction of arrow 20. Mast tubular elements 22, 24, 26, and 28 comprise mast 12 as shown in the fully extended position.

Figure 2:
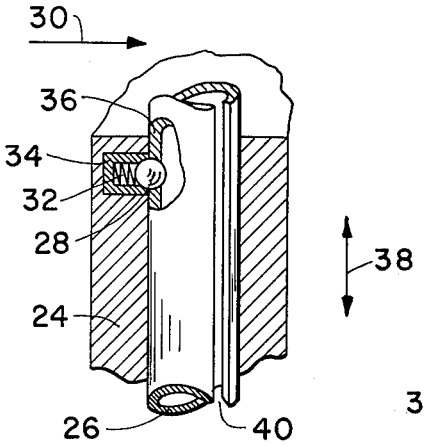
FIG. 2 is a cross-sectional front elevation view of a pair of telescoping elements and a locking apparatus.

FIG. 2 illustrates a portion of mast element 26, residing in a portion of mast element 24. Detenting sphere 28 is urged in the direction of arrow 30 by spring 32, shown within spring housing 34. Sphere 28 resided in circular opening 36 formed within the walls of mast element 26. Thus, mast element 26 is restrained in moving in the direction of arrows 38 due to the locking forces exerted on opening 36 by sphere 28. Sufficiently strong opposed forces, exerted on mast elements 26 and 24 causes sphere 28 to overcome the bias forces exerted by spring 32 enabling the disengagement from circular opening 36 so as to permit the relative displacement of mast element 26 from mast element 24 in the directions of arrows 38. Slot 40 is shown piercing the walls of mast element 26, running in a direction parallel to the longitudinal axis of mast element 26.

Figure 3:
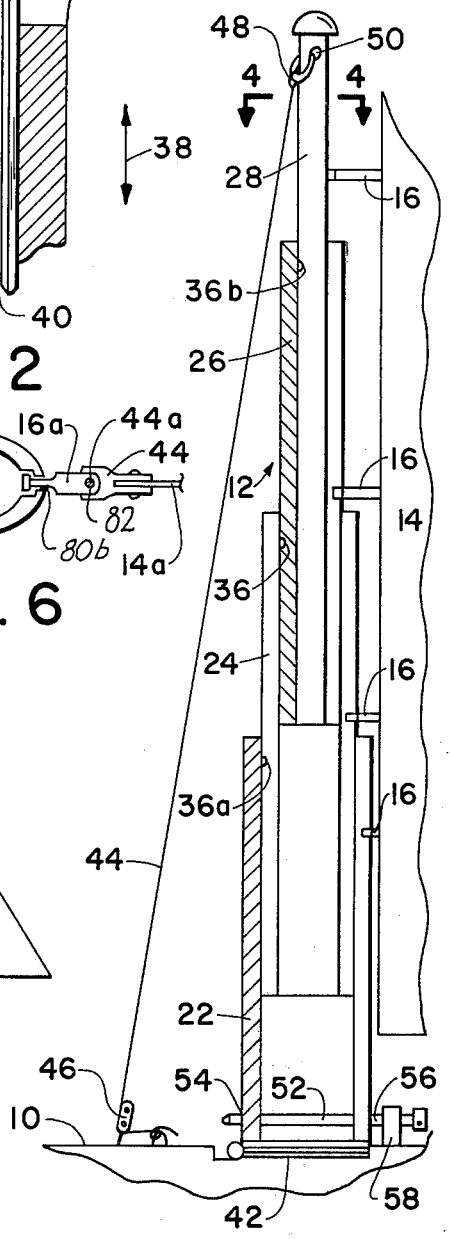
FIG. 3 is a front elevation cross-sectional view of the mainmast depicted in FIG. 1, showing the mainmast hingeably secured to the deck portions of the vessel.

FIG. 3 illustrates deck 10 supporting lowermost tubular element 22 upon the upper plate of barrel hinge 42. Line 44 extends upwardly from cleat 46, passing through pulley 48 secured to the top 50 of mast 12. Sliders 16 extend outwardly from the walls of tubular elements 22, 24, 26, and 28 supporting mainsail 14. Circular opening **36*a*, 36, and 36*b* are shown within the walls of tubular elements 24, 26, and 28 respectively. Spheres, not shown, reside within the walls of adjacent tubular elements 22, 24, and 26 respectively, maintaining the mast in the upright position shown. Pin 52 passes through openings 54 and 56 within lowermost tubular element 22, maintaining the mast in the upright position due to the support provided by block 58 secured to deck 10. When pin 52 is removed from openings 54 and 56, mast 12 may be pivoted on barrel hinge 42 to a position parallel to deck 10**.

Figure 4:
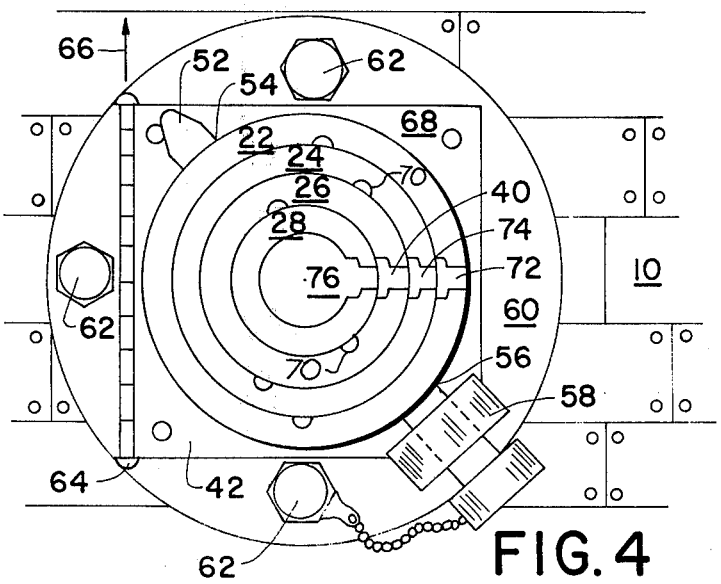
FIG. 4 is a cross-sectional plan view taken along line 4—4 viewed in the direction of arrows 4—4 as shown in FIG. 3 illustrating the mainmast apparatus.

FIG. 4 shows circular plate 60 secured to deck 10 utilizing bolts 62 therefor. Barrel hinge 42 is affixed to lowermost tubular element 22. Barrel hinge pin 64, when removed, by pulling in the direction of arrow 66, enables the mast elements 22, 24, 26, and 28 and the uppermost plate 68, of the barrel hinge, to be disengaged from securement with deck 10, provided pin 52 has been removed from block 58 and from openings 54 and 56 in tubular element 22. Semi-circular projections 70 extend outwardly from tubular element 28 and engage mating semi-circular notches in tubular element 26. In like fashion, semi-circular protrusions extend radially outwardly from tubular elements 26 and 24, engaging semi-circular notches in tubular elements 24 and 22 thereby aligning T-shaped longitudinal slots 72, 74, 40 and 76, located in tubular elements 22, 24, 26, and 28 respectively. Sliders 16, shown in FIG. 1, engage T-shaped longitudinal slots 72, 74, 40 and 76, by having their cap portion of their T-shaped cross-section engaged within the widest portions of the T-shaped notches and by having their leg portions extend radially outwardly from the tubular elements in which they reside.

Figure 5:
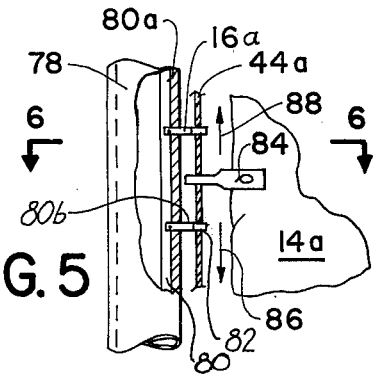
FIG. 5 is a partial side elevation view of an alternate embodiment illustrating a mainsail securing line.

FIG. 5 illustrates a tubular element 78 in which slot 80 extends along the longitudinal length thereof. Caps 82, of sliders **16*a*, reside in the widened portion 80*a* of the slot 80. Legs 80B emerge from slot 80 and permit line 44*a* to pass through openings 82 therein. Mainsail tab 84 is secured to mainsail 14*a* at one end and grasps line 44*a*, securely, at another end thereof. When line 44*a* is caused to move in the directions of arrows 86 and 88, sail 14*a*** is forced to move in similar directions.

Figure 6:
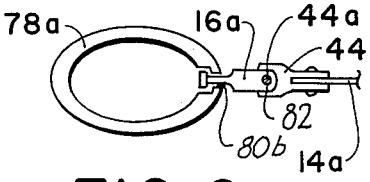
FIG. 6 is a cross-sectional view taken along line 6—6 viewed in the direction of arrows 6—6 as shown in FIG. 5 illustrating the elliptical cross-section of the mast and mainsail height controlling line.

FIG. 6 illustrates tubular element **78*a* shown having an elliptical cross-section. T-shaped slider 16*a* is shown captured within T-shaped slot 80*b* disposed within the walls of elliptical tubular element 78*a*. Line 44*a* is illustrated passing through opening 82 and is captured by tab 84 secured to mainsail 14*a***.

One of the advantages of the present invention is a mast which may be collapsed into its shortest position without requiring manual manipulation at the sight of those elements utilized to maintain the mast in an extended position.

Another advantage of the present invention is a collapsible mast which may be hingeably and removably affixed to a deck of a sailboat.

Still another advantage of the present invention is a collapsible mainmast which adequately and effectively provides lateral and vertical support to a mainsail leading edge at a plurality of points there-along.

Yet another advantage of the present invention is a collapsible mainmast whose mainsail supporting means is always maintained abaft the mainmast.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A retractable sailboat mast comprising a plurality of tubular elements telescopingly slidingly engaged within one another, detenting means for compressively releasably detenting adjacent tubular elements when said adjacent tubular elements are extended outwardly from one another along a common longitudinal axis thereof, aligning means for rotationally aligning said plurality of tubular elements to one another, each of said plurality of tubular elements having a slot in the walls thereof, the longitudinal axis of said slot extending parallel to said common longitudinal axis, said slot of said each of said plurality of tubular elements co-axially aligned, sail supporting means for providing lateral support to a sail, said sail supporting means positioning a portion of said sail adjacent said slot, mast supporting means for removably and pivotably securing said retractable sailboat mast to a deck of a sailing vessel.

2. The retractable sailboat mast as claimed in claim 1 wherein said detenting means comprises a sphere, a spring, a housing, an opening, said housing being disposed in the walls of one tubular element of said plurality of tubular elements, said spring being disposed within said housing, said sphere being disposed adjacent the innermost surface of said one tubular element and partially protruding through a hole therein, said spring urging said sphere radially inwardly towards said common longitudinal axis, said opening being disposed in the outermost surface of an adjacent tubular element to said one tubular element, said protruding portion of said sphere being disposed within said opening detentingly securing said adjacent tubular element to said one tubular element.

3. The retractable sailboat mast as claimed in claim 1 wherein said aligning means comprises a protrusion fixedly secured to the exterior surface of one tubular element of said plurality of tubular elements, said protrusion extending substantially the length of said one tubular element and parallel to said common longitudinal axis, a notch, said notch having a complementary cross-section to the cross-section of said protrusion, said notch being disposed within the interior surface of an adjacent tubular element, said notch running substantially the entire length of said adjacent tubular element and parallel to said common longitudinal axis.

4. The retractable sailboat mast as claimed in claim 1 wherein said sail supporting means comprises a sliding element, said sliding element slideably engaged within said slot, a portion of said sliding element emerging radially outwardly from the opening of said slot adjacent the outermost surface in the tubular element in which said slot resides, the remaining portions of said sliding element confined within said slot, restraining means for preventing said remaining portions of said sliding element from removal from said slot radially outwardly from said common longitudinal axis, sail fastening means for securing said portion of said sail to said portion of said sliding element.

5. The retractable sailboat mast as claimed in claim 4 wherein said sliding element comprises a T-shaped cross-section, said slot having a wider portion thereof adjacent the innermost surface of said tubular element in which said slot resides.

6. The retractable sailboat mast as claimed in claim 4 further comprising a flexible line, an opening in said sliding element, said flexible line passing through said opening in said sliding element, said sail fastening means clampingly secured to said flexible line at discreet spaced apart locations therealong.

7. The retractable sailboat mast as claimed in claim 1 wherein said mast supporting means comprises a barrel hinge, a block, a pin, a pair of openings in the lower end of the outermost tubular element of said plurality of tubular elements, one plate of said barrel hinge fixedly secured to said deck, the other plate of said barrel hinge fixedly secured to the lowermost edge of said outermost tubular element, said barrel hinge having a removable hinge pin, a hole in said block, said pin being disposed removably passing through said hole and said pair of openings.

8. The retractable sailboat mast as claimed in claim 1 wherein said plurality of tubular elements comprise right angle circular cylinders.

9. The retractable sailboat mast as claimed in claim 1 wherein said plurality of tubular elements comprise right angle elliptical cylinders.

* * * * *